US006533249B2

(12) United States Patent
Ochoa

(10) Patent No.: US 6,533,249 B2
(45) Date of Patent: Mar. 18, 2003

(54) GUARDRAIL BEAM WITH IMPROVED EDGE REGION AND METHOD OF MANUFACTURE

(75) Inventor: Carlos M. Ochoa, Dallas, TX (US)

(73) Assignee: ICOM Engineering, Inc., Plano, TX (US)

( * ) Notice: Subject to any disclaimer, the term of this patent is extended or adjusted under 35 U.S.C. 154(b) by 0 days.

(21) Appl. No.: 09/753,868

(22) Filed: Jan. 2, 2001

(65) Prior Publication Data

US 2002/0021937 A1 Feb. 21, 2002

Related U.S. Application Data

(63) Continuation-in-part of application No. 09/405,434, filed on Sep. 23, 1999, now Pat. No. 6,290,427.

(51) Int. Cl.[7] ..... E01F 15/00
(52) U.S. Cl. ..... 256/13.1; 404/6
(58) Field of Search ..... 404/6; 256/13.1

(56) References Cited

U.S. PATENT DOCUMENTS

| | | | | |
|---|---|---|---|---|
| 1,847,025 A | | 2/1932 | Stockard | |
| 1,849,167 A | | 3/1932 | Bente | |
| 1,974,232 A | | 9/1934 | Brown | 256/13.1 |
| 1,989,763 A | | 2/1935 | McFarland | 256/18.1 |
| 2,007,185 A | | 7/1935 | Edgecombe | 256/13.1 |
| 2,047,436 A | | 7/1936 | Shepherd | 256/13.1 |
| 2,047,990 A | * | 7/1936 | Carswell et al. | 256/13.1 |
| 2,060,673 A | | 11/1936 | Hick | 256/13.1 |
| 2,085,098 A | | 6/1937 | Height et al. | 256/13.1 |
| 2,088,001 A | | 7/1937 | Schulz | 256/13.1 |
| 2,089,929 A | | 8/1937 | Brickman et al. | 256/13.1 |
| 2,091,195 A | | 8/1937 | Dennebaum | 267/69 |

(List continued on next page.)

FOREIGN PATENT DOCUMENTS

| | | | |
|---|---|---|---|
| CH | 376 535 | 2/1960 | |
| CH | 378 358 | 6/1961 | |
| CH | 401 121 | 10/1965 | E01F/15/00 |
| CH | 433422 | 8/1966 | E01F/15/00 |
| EP | 0 379 424 | 7/1990 | E01F/15/00 |
| FR | 1 258 539 | 7/1961 | |
| FR | 2 607 841 | 6/1988 | E01F/15/00 |
| WO | WO 97/25482 | 7/1997 | E01F/15/00 |
| WO | WO 00/49232 | 8/2000 | E01F/15/04 |

OTHER PUBLICATIONS

Existing Guardrail Shapes.
O–Rail (brochure), TrinityIndustries, Inc., 1999.
PTC Search Report U.S. 99/29848.
Standard Specification for Corrugated Sheet Steel Beams for Highway Guardrail, AASHTO Designation: M 180–89, pp. 309–313.
Standard Specification for Corrugated Sheet Steel Beams for Highway Guardrail, AASHTO Designation: M 180–79, pp. 419–423.

(List continued on next page.)

*Primary Examiner*—Gary S. Hartmann
(74) *Attorney, Agent, or Firm*—Baker Botts L.L.P.

(57) ABSTRACT

A guardrail beam for installation along a roadway is provided with a first or top edge region and a second or bottom edge region. A plurality of crowns may be disposed longitudinally along the guardrail beam between the first, top edge region and the second, bottom edge region. Each edge region preferably includes a first, edge flange and a second, slot flange with a plurality of splice bolt slots disposed therein. A radius between less than three-eighths of an inch and approximately one-sixteenth of an inch is preferably formed between each first, edge flange and adjacent second, slot flange. Also, each first, edge flange preferably extends at an angle between approximately twenty-five degrees and one hundred twenty-five degrees relative to the second, slot flange.

24 Claims, 5 Drawing Sheets

U.S. PATENT DOCUMENTS

| | | | | | |
|---|---|---|---|---|---|
| 2,091,925 | A | | 8/1937 | Heltzel | 256/13.1 |
| 2,135,705 | A | | 11/1938 | Florance | 256/13.1 |
| 2,168,930 | A | | 8/1939 | Bradshaw | 256/13.1 |
| 2,204,559 | A | | 6/1940 | Ahles | 256/13.1 |
| 2,228,652 | A | | 1/1941 | Dailey | 256/13.1 |
| 2,536,760 | A | | 1/1951 | Martin et al. | 256/13.1 |
| 2,776,116 | A | | 1/1957 | Brickman | 256/13.1 |
| 2,979,307 | A | | 4/1961 | Crone | 256/13.1 |
| 3,214,142 | A | | 10/1965 | Brown et al. | 256/13.1 |
| 3,284,054 | A | | 11/1966 | St. Pierre | 256/13.1 |
| 3,332,666 | A | | 7/1967 | Gray | 256/13.1 |
| 3,417,965 | A | | 12/1968 | Gray | 256/13.1 |
| 3,603,562 | A | | 9/1971 | Glaesener | 256/13.1 |
| 3,776,520 | A | | 12/1973 | Charles et al. | 256/13.1 |
| 3,845,936 | A | | 11/1974 | Boedecker, Jr. et al. | 256/1 |
| 4,063,713 | A | | 12/1977 | Anolick et al. | 256/13.1 |
| 4,222,552 | A | | 9/1980 | Matteo, Sr. | 256/13.1 |
| 4,295,637 | A | | 10/1981 | Hulek | 256/13.1 |
| 4,330,106 | A | | 5/1982 | Chisholm | 256/13.1 |
| 4,423,854 | A | | 1/1984 | Cobb et al. | 256/13.1 |
| 4,460,161 | A | | 7/1984 | Grenga | 256/13.1 |
| 4,655,434 | A | * | 4/1987 | Bronstad | 256/13.1 |
| 4,678,166 | A | | 7/1987 | Bronstad et al. | 256/13.1 |
| 4,815,565 | A | | 3/1989 | Sicking et al. | 188/32 |
| 4,928,928 | A | | 5/1990 | Buth et al. | 256/13.1 |
| 5,044,609 | A | | 9/1991 | Cicinnati et al. | 256/13.1 |
| 5,069,576 | A | | 12/1991 | Pomero | 404/6 |
| 5,078,366 | A | | 1/1992 | Sicking et al. | 256/13.1 |
| 5,152,507 | A | | 10/1992 | Lee | 256/13.1 |
| 5,391,016 | A | | 2/1995 | Ivey et al. | 404/6 |
| 5,407,298 | A | | 4/1995 | Sicking et al. | 404/6 |
| 5,429,449 | A | | 7/1995 | Baatz | 404/6 |
| 5,503,495 | A | | 4/1996 | Mak et al. | 404/6 |
| 5,547,309 | A | | 8/1996 | Mak et al. | 404/6 |
| 5,775,675 | A | | 7/1998 | Sicking et al. | 256/13.1 |
| 5,791,812 | A | | 8/1998 | Ivey | 404/6 |
| 5,860,762 | A | | 1/1999 | Nelson | 404/6 |
| 5,924,680 | A | | 7/1999 | Sicking et al. | 256/13.1 |
| 5,931,448 | A | | 8/1999 | Sicking et al. | 256/13.1 |
| 5,954,111 | A | | 9/1999 | Ochoa | 160/201 |
| 5,957,435 | A | | 9/1999 | Bronstad | 256/13.1 |
| 5,967,497 | A | | 10/1999 | Denman et al. | 256/13.1 |
| 5,988,598 | A | | 11/1999 | Sicking et al. | 256/13.1 |
| 6,022,003 | A | | 2/2000 | Sicking et al. | 256/13.1 |
| 6,059,487 | A | | 5/2000 | Haga et al. | 404/6 |
| 6,082,429 | A | | 7/2000 | Ochoa | 160/201 |
| 6,089,782 | A | | 7/2000 | Bligh et al. | 404/6 |
| 6,109,597 | A | | 8/2000 | Sicking et al. | 256/13.1 |
| 6,129,342 | A | | 10/2000 | Bronstad | 256/13.1 |
| 6,142,452 | A | * | 11/2000 | Denman et al. | 256/13.1 |
| 6,149,134 | A | | 11/2000 | Bank et al. | 256/13.1 |
| 6,173,943 | B1 | * | 1/2001 | Welch et al. | 256/13.1 |
| 6,220,575 | B1 | | 4/2001 | Lindsay et al. | 256/13.1 |
| 6,244,571 | B1 | | 6/2001 | Reid et al. | 256/13.1 |
| 6,254,063 | B1 | | 7/2001 | Rohde et al. | 256/13.1 |
| 6,260,827 | B1 | * | 7/2001 | Sicking et al. | 256/13.1 |
| 6,299,141 | B1 | | 10/2001 | Lindsey et al. | 256/13.1 |
| 6,308,809 | B1 | | 10/2001 | Reid et al. | 18/388 |
| 6,416,041 | B1 | | 7/2002 | Sicking et al. | 256/13.1 |
| 2001/0013596 | A1 | | 8/2001 | Sicking et al. | 256/13.1 |
| 2002/0007994 | A1 | | 1/2002 | Reid et al. | 188/377 |

OTHER PUBLICATIONS

PCT Search Report for PCT/US 02/11005. Mailed Jul. 18, 2002.

PCT Search Report for PCT/US 01/45265. Mailed Jun. 26, 2002.

* cited by examiner

GUARDRAIL BEAM WITH IMPROVED EDGE REGION AND METHOD OF MANUFACTURE

RELATED APPLICATION

This application is a continuation in part of application Ser. No. 09/405,434 filed Sep. 23, 1999 entitled: Guardrail Beam with Enhanced Stability now issued as U.S. Pat. No. 6,290,427.

This application is related to copending application Ser. No. 09/663,327 filed Sep. 18, 2000 entitled Guardrail With Enhanced Stability.

TECHNICAL FIELD OF THE INVENTION

The present invention relates generally to roadway safety devices and more particularly, to a guardrail beam having enhanced stability which minimizes failure and provides for more reliable, predictable response of the guardrail beam during a vehicle collision or impact.

BACKGROUND OF THE INVENTION

A goal of roadway safety is to provide a forgiving roadway and adjacent roadside for errant motorists. Guardrail systems are employed along a roadside to accomplish multiple tasks associated with roadway safety. Upon vehicle impact, a guardrail must react as a brake and shock absorber to dissipate kinetic energy of the vehicle. Subsequently, the guardrail acts as a mechanical guide to redirect the vehicle away from hazards during deceleration and to prevent the vehicle from leaving the roadway, becoming airborne or rebounding into lanes of moving traffic. For many years, standard heavy gauge metal guardrail, often referred to as the "W-beam", has been used on the nation's roadways to accomplish these tasks and others. Named after its characteristic shape, a W-beam guardrail system is typically anchored to the ground using posts made of metal, wood or a combination of both.

Recently, there has been a vigorous effort to raise performance standards which guardrails must satisfy. Increasingly stringent testing criteria have uncovered some deficiencies in performance of standard W-beam guardrails. Considering the pervasive extent of use of standard W-beam guardrails, performance deficiencies, that have come to light as more comprehensive and rigorous test specifications are implemented, must be addressed.

A typical highway guardrail system is formed from a plurality of standard heavy gauge metal W-beams or panels which are overlapped with respect to each other at a standard splice. Depending upon the location of impact and kinetic energy associated with an impacting vehicle, interlocking or overlapping standard W-beams or panels may rotate relative to each other at the splice.

Upon a vehicle's impact with a guardrail, a dynamic response is obtained from the guardrail. The response may include vibration of the guardrail in a direction parallel to the ground and perpendicular to the direction of the vehicle. A standard W-beam guardrail may respond somewhat effectively when the waves are in a direction away from the vehicle. However, as the standard W-beam guardrail returns in a direction toward the vehicle, standard W-beams tend to buckle or crimp at the top and bottom edges. At this point, the standard W-beam's ability to absorb energy by plastic moment is significantly deteriorated. Furthermore, as the vehicle continues its path along the guardrail, it interacts with the edge of any buckled W-beam sections. This may result in tearing of the associated W-beam material starting at the top edge or bottom edge and may often occur in the region where two standard W-beams are overlapped.

Accordingly, recent efforts have focused on the development of a new guardrail system that will accomplish safety goals more effectively. One such design included a deeper and wider "W-beam." However, this change in geometry generally requires a significant increase in hardware to attach adjacent beams or panels at each splice. Such alternative systems have not gained widespread industry acceptance because they have typically lacked the ability to efficiently interface with existing guardrail systems.

Other efforts have attempted to address typical failure modes associated with standard W-beams through system changes without changing the guardrail panel design itself. As a result, these efforts have met with only limited success, since the combination of crash event variables which may produce typical failure modes are both numerous and diverse. Thus, simply changing the configuration of a guardrail system or installation in this way generally offers little promise of significant improvement during vehicle impact.

SUMMARY OF THE INVENTION

The present invention achieves significant guardrail system performance enhancements by improving the guardrail panel design itself. Simple, precise design changes in specifically combined ratios according to the present teachings provide the basis for these novel and unexpectedly synergistic enhancements to stability and strength during service. The significance of the present invention is amplified by the ability of the new improved designs to be retrofitable, and thus to be used for both the repair and replacement of existing installations.

One aspect of the present invention is to provide an improved guardrail system for use in various locations such as median strips and adjacent to roadways. The improved guardrail system is preferably formed from a plurality of guardrail beams having a first edge region and a second edge region formed in accordance with teachings of the present invention. Guardrail beams or panels having such edge regions are generally more fracture resistant and tend to more evenly spread stresses sustained during impact between a vehicle and the associated guardrail system. Guardrail beams or panels incorporating teachings of the present invention may thus withstand significant forces of vehicle impact while maintaining adequate safety for vehicles, passengers, and bystanders.

Another aspect of the present invention is providing cost-effective, retrofitable guardrail beams or panels which may be employed interchangeably along with, or in lieu of existing guardrail systems. Still another aspect is to provide a guardrail system capable of dissipating impact energy of a vehicle collision more effectively than existing guardrail systems.

A guardrail beam or panel incorporating teachings of the present invention typically has an elongated, rectangular configuration defined in part by a first edge region and a second edge region with a front face and a rear face disposed therebetween. At least two folds are formed in the guardrail beam and extend outwardly from the rear face to provide a typical W-beam cross-section between the first edge region and the second edge region.

The first edge region is defined in part by a first flange or edge flange and a second flange or slot flange extending generally parallel with and adjacent to the first flange. The second edge region is defined in part by a corresponding edge flange and slot flange. The edge regions cooperate with each other to create a more uniform, stable and predictable response during vehicle impact. A plurality of post bolt holes and splice bolt slots are preferably provided to allow the guardrail beam to be used interchangeably with existing guardrail systems.

Technical advantages of a guardrail beam having edge regions formed in accordance with teachings of the present invention include better stabilization against crack growth that may originate near a bolt hole, a splice bolt slot or at other locations along the length of the guardrail beam. This enhanced fracture resistance is enabled by the combined effect of radius and angle between two adjacent flanges, and is still further enhanced in a compounding manner by the appropriate choice of radius to thickness ratio. This ratio serves to accomplish the dual role, first of maximizing the amount of strain hardening in the radius region which itself serves as a barrier to crack growth, and second, of emphasizing the stiffening and constraining role of one flange with respect to the other which serves as an additional crack barrier. This dual stabilization has a compounding effect against the growth of cracks that may originate near bolt holes, splice bolt slots, and other locations along the length of the guardrail beam or panel. It results in a stronger guardrail beam which is better able to resist damage resulting from impact by a vehicle. The combined effect is so significant that for some applications the strength of resulting splice bolt slots may be increased by as much as a factor of about three (3).

Another technical advantage of a guardrail system formed in accordance with teachings of the present invention includes increased stability against crimping of associated guardrail beams or panels as compared with standard heavy gauge metal W-beam guardrails. Guardrail beams having edge regions defined in part by a first edge flange and an adjacent second, slot edge flange formed in accordance with teachings of the present invention are generally more resistant to edge crimping instabilities during a vehicle impact. This is due to the fact that for edge flanges arranged relative to one another with specific combinations of radius to thickness ratios and specific ranges of angles, the edge region is significantly stabilized and thus more resistant to crimping. For some applications, the angle preferably has a value in the range of approximately twenty-five degrees (25°) to one hundred twenty-five degrees (125°).

Another aspect of the present invention includes providing guardrail panels with at least one edge region having a first, edge flange and an adjacent second, slot flange disposed at a selected angle relative to each other and with a selected radius formed therebetween to provide greater resistance to rotation of one panel relative to another panel at a standard splice. Greater resistance to rotation during a crash event is enabled as the edge flanges more effectively interlock the panels at the splice during installation. At the same time the radius to thickness ratio ensures significant work hardening of the material in the region of the radius when work hardenable materials are used. This work hardening effect is synergistic with other aspects of the design in that it significantly strengthens the support of the cantilevered edge flange in the region of highest local bending stresses that would work to let the edge flange simply deform and thus permit rotation of one panel relative to the other at the splice. This higher strength is added without compromising the ease of installing the panels relative to each other.

It may be noted that local heat treatment, welding operations, or mechanical working of the material in the radius region may be performed to further accomplish the above strengthening effect. It may also be noted that in the case of panels that are substantially made of a sheet base metal such as steel, the thickness that is used in calculating the radius to thickness ratios is typically that of the uncoated base metal from which the panel is formed. It may also be noted that for some applications, the angles formed between the first, edge flange and adjacent second, slot flange may be varied along the length of each panel in order to achieve various design objectives for the overall system while substantially maintaining the benefits of the teachings of the present invention. The angles associated with the respective edge regions may also be varied to minimize manufacturing costs.

A further technical advantage of a guardrail panel incorporating teachings of the present invention includes a first edge region and a second edge region having more stability to resist crimping than is commonly associated with the blade edge of standard W-beam panels. Crimping may be defined as an edge buckling instability commonly associated with open section structures subjected to bending loads. Guardrail beams or panels having edge regions formed in accordance with teachings of the present invention generally resist crimping more effectively, thus substantially adding to the stability of the guardrail beam section. This in turn enables the panels to demonstrate more uniform stresses over the cross-section of the guardrail panel or beam during a vehicle impact. This more uniform stress distribution is crucial in achieving more uniform and stable system response and thus increased performance effectiveness while resisting and guiding the impacting vehicle.

Still another technical advantage includes a splice bolt slot configuration that facilitates retrofit and/or replacement of existing guardrail systems with one or more beams or panels formed in accordance with teachings of the present invention without requiring substantial modifications to existing equipment and other portions of the existing guardrail system.

The teachings of the present invention are primarily discussed within this document as being specifically applied to critical edge regions of a guardrail panel. However, the same principles and teachings may also be combined with other features or material processing steps, including local heat, pressure, laser or electromagnetic treatments, as they are applied to any region of a panel cross section of a new or existing guardrail panel design, wherever local changes in the section shape may already occur or are desired. In such cases extended local application of the present principles in a panel cross-section can be used for example to accomplish redistribution of material mass or strength. This implementation may be varied along the panel length in order to address specific design objectives. Naturally, as a panel is tailored in this way, economies of processing simplicity and material usage remain as practical considerations.

In summary, providing guardrail panels with edge regions formed in accordance with teachings of the present invention results in significantly more stable interaction between an associated guardrail system and an impacting vehicle. This is because the guardrail system is better able to resist local rotation and stresses at each splice, and the fact that the edges are significantly stabilized against crimping that is associated with instability and weakening of the guardrail section. The present invention thus enables tailored configurations of guardrail panels and their associated guardrail system in order to optimize trade offs between performance and ease of installation at each point along the length of the guardrail system. While many modifications to a standard W-beam guardrail system are possible, the embodiments of the present invention can greatly enhance the resistance of the resulting guardrail system to failure. In fact, the magnitude of this effect is both surprising and novel. Moreover, significant benefits may be provided without substantially compromising other desirable characteristics of the standard W-beam such as overall simplicity and diversity of application. The result is a new guardrail system that may be substantially more consistent, predictable, and reliable in light of current performance and testing standards.

Other technical advantages are readily apparent to one skilled in the art from the following figures, descriptions, and claims.

BRIEF DESCRIPTION OF THE DRAWINGS

For a more complete understanding of the present invention, and the advantages thereof, reference is now made to the following brief descriptions, taken in conjunction with the accompanying drawings and detailed description, wherein like reference numerals represent like parts, in which.

DETAILED DESCRIPTION OF THE INVENTION

Preferred embodiments of the present invention and its advantages are best understood by referring now in more detail to FIGS. 1–8 of the drawings, in which like numerals refer to like parts.

Figures 1, 1A:
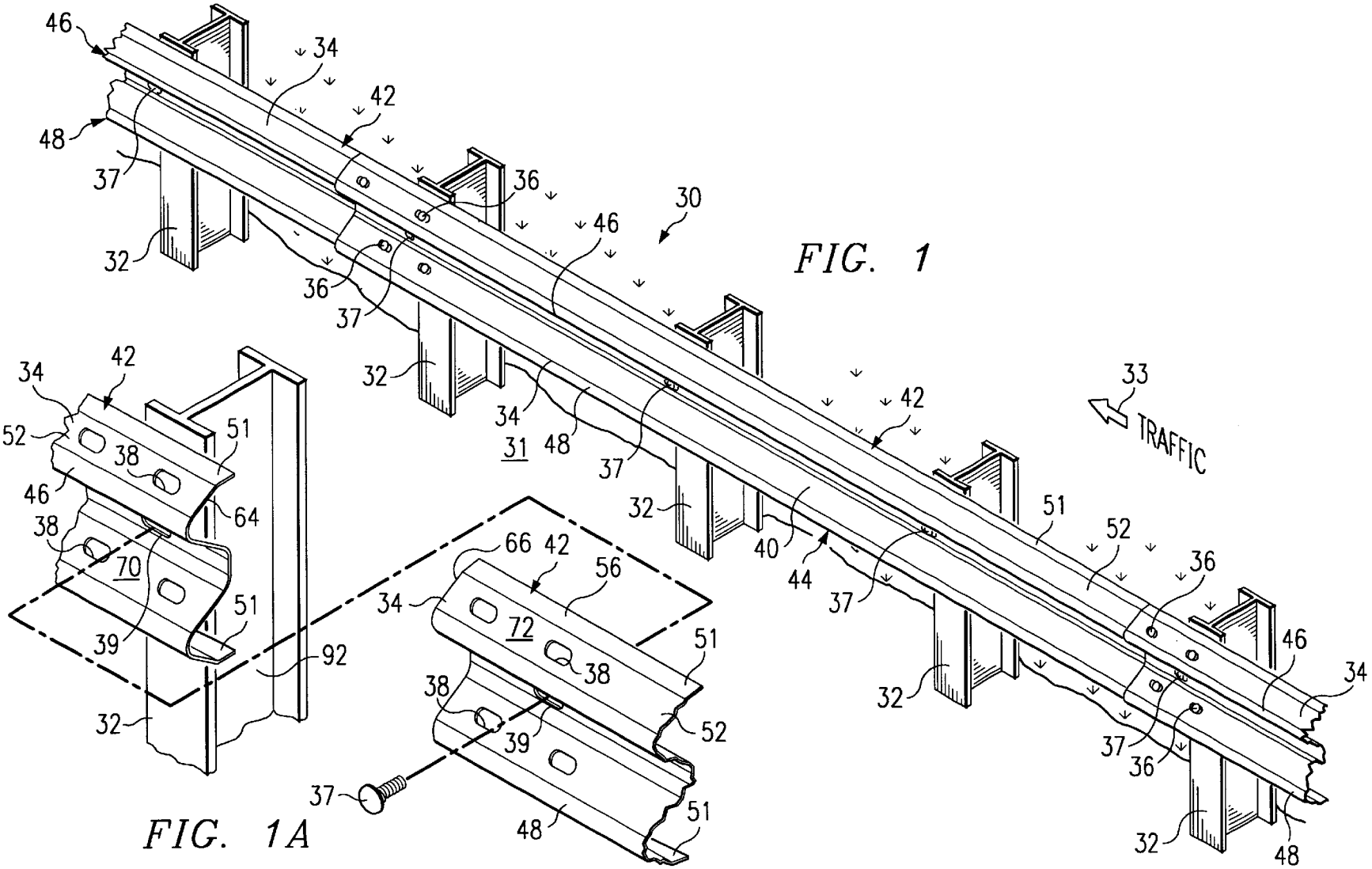
FIG. 1 is a schematic drawing showing an isometric view with portions broken away of a guardrail system installed along a roadway, incorporating teachings of the present invention.
FIG. 1A is a schematic drawing showing an isometric view with portions broken away of a splice or overlapping connection between adjacent guardrail beams or panels, of the guardrail system of FIG. 1.

Referring to FIG. 1, guardrail system 30 is shown installed adjacent to roadway 31. The direction of oncoming traffic along roadway 31 is illustrated by directional arrow 33. Guardrail system 30 includes a plurality of support posts 32 anchored adjacent to roadway 31 with a plurality of guardrail beams or panels 34 attached to support posts 32 and secured by post bolts 37. For illustrative purposes, FIG. 1 includes one complete guardrail beam 34 and two partial sections of adjacent guardrail beams 34 to illustrate the splice connections between adjoining guardrail beams 34.

Guardrail system 30 may be installed along roadway 31 in order to prevent motor vehicles (not expressly shown) from leaving roadway 31 and to redirect vehicles away from hazardous areas (not expressly shown) without causing serious injuries to the vehicle's occupants or other motorists. Guardrail systems incorporating aspects of the present invention may be used in median strips or shoulders of highways, roadways, or any path which is likely to encounter vehicular traffic. Guardrail beam 34 may also be used in conjunction with a variety of guardrail end treatments including those currently available and in widespread use.

Support posts 32 are provided to support and maintain guardrail beams 34 in a substantially horizontal position along roadway 31. Posts 32 are typically anchored below or alongside roadway 31. Posts 32 may be fabricated from wood, metal, or a combination of wood and metal. "Break away" support posts may be provided to facilitate a predetermined reaction to a specified crash event.

The number, size, shape and configuration of support posts 32 may be significantly modified within the teachings of the present invention. For instance, support posts may be formed of a material that will break away upon impact, such as wood. In one embodiment, support posts satisfactory for use with the present invention may be formed from two wood sections. The first wood section (not expressly shown) may be disposed underneath roadway 31. The second wood section (not expressly shown) may be disposed above roadway 31 with means for connecting the first wood section with the second wood section. Similarly, support posts 32 may be comprised of two metal sections, the first metal section being an I-beam disposed below roadway 31 and the second metal section being an I-beam disposed above roadway 31, with means for connecting the I-beam sections together.

Figure 2:
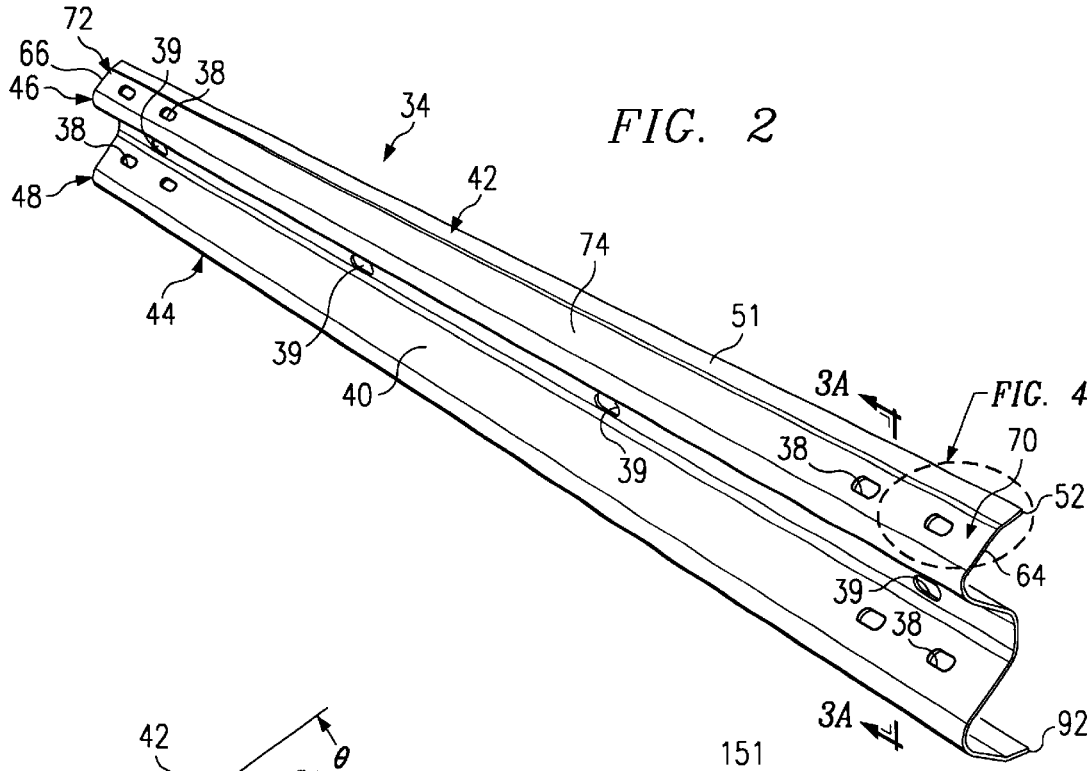
FIG. 2 is a schematic drawing showing an isometric view of a guardrail beam or panel incorporating one embodiment of the present invention.

Referring now to FIGS. 1, 1A and 2 guardrail-beams 34 may be secured to support posts 32 through a plurality of post bolt slots 39 and corresponding post bolts 37. Adjacent guardrail beam 34 may be coupled or spliced with one another by a plurality of splice bolts 36 protruding through splice bolt slots 38. The number, size and configuration of bolts 36 and 37, and slots 38 and 39 may be significantly modified within the teachings of the present invention. In the illustrated embodiment, the configuration of slots 38 and 39 and bolts 36 and 37 comply with American Association of State Highway Transportation Officials (AASHTO) Designation M180-89. Suitable hardware, including nuts and washers may be provided to secure bolts 36 and 37. Various other mechanical fastening techniques and components may be employed within the teachings of the present invention.

Guardrail beams 34 are preferably formed from sheets of a base material such as steel alloys suitable for use as highway guardrail. Guardrail beam 34 of the present invention may be manufactured by conventional "roll form" methods using steel alloy materials associated with standard heavy gauge W-beam guardrails. Guardrail beam 34 preferably retains many of the standard dimensions associated with standard heavy gauge metal W-beam guardrails. In one embodiment, guardrail beam 34 may be designed and fabricated according to AASHTO Designation M180-89.

Guardrail beam 34 preferably includes front face 40, and rear face 41, disposed between first, top edge region 42 and second, bottom edge region 44. Front face 40 is preferably disposed adjacent to roadway 31. First crown 46 and second crown 48 are formed between top edge region 42 and bottom edge region 44. Both first edge region 42 and second edge region 44 preferably include respective first, edge flange 51 and a second, slot flange 52. See FIG. 3A. The relationship between first, edge flange 51 and second, slot flange 52 will be discussed later in more detail. Although the embodiment illustrated in FIG. 1 has a generally W-beam shape, other shapes, including but not limited to a "Thrie-Beam," may be suitable for use within teachings of the present invention, including the embodiments illustrated in FIGS. 7 and 8.

The total length of a typical guardrail beam 34 measured from leading edge 64 to trailing edge 66 as illustrated in FIG. 2, is approximately twenty-five (25) feet. Other lengths of guardrail section including, but not limited to one-half lengths, or twelve and one-half foot members, may also be provided within teachings of the present invention. Edge regions 42 and 44 and the overall geometry of guardrail beam 34 allow combining guardrail beam 34 and conventional or standard W-beam guardrails within a single guardrail system, to maintain the benefits described herein. Accordingly, guardrail beams 34 may be incorporated into existing guardrail systems as needed, and an entire retrofit of any particular guardrail system is not required in order to recognize the benefits of the present invention. In fact, the overall geometry of guardrail beam 34 is configured to accommodate a close fit between conventional or standard W-beam guardrails. See FIGS. 3A and 3B.

Guardrail beam 34, formed in accordance with teachings of the present invention, provides improved safety performance and protection of the general public. Recently, increased interest in the need for more stringent safety requirements has culminated in the issuance of the National Cooperative Highway Research Program Report 350 (NCHRP 350). The performance standards of NCHRP 350 require all new safety hardware to be tested with larger vehicles than required by previous standards. NCHRP 350 evaluates all safety hardware within three areas: structural adequacy, occupant risk, and vehicle trajectory. Each area has corresponding evaluation criteria. The Federal Highway Administration (FHWA) officially adopted these new performance standards and has ruled that all safety hardware installed after August of 1998 will be required to meet the new standards. The geometric configuration of guardrail beam 34, as illustrated in FIGS. 1–4, enhances its ability to respond in a more uniform and predictable manner during crash testing and in-service impacts or collisions.

Upstream end 70 of each guardrail beam 34 is generally defined as the portion beginning at leading edge 64 and extending approximately thirteen (13) inches along guardrail beam 34 toward trailing edge 66. Similarly, downstream end 72 is generally defined as the portion of guardrail beam 34 beginning at trailing edge 66 and extending approximately thirteen (13) inches toward the associated leading edge 64. Intermediate portion 74 of each section of guardrail beam 34 extends between respective upstream end 70 and downstream end 72.

A vehicle traveling along the right side of roadway 31 will approach from upstream end 70 or leading edge 64 and subsequently depart from downstream end 72 or trailing edge 66 of guardrail beam 34. Each section of guardrail beam 34 is preferably joined with additional guardrail beams 34 such that they are lapped in the direction of oncoming traffic to prevent edges which may "snag" a vehicle or object as it travels along front face 40 of guardrail beam 34. Accordingly, a section of guardrail beam 34 installed at leading edge 64 would be installed upon front face 40 of adjacent guardrail beam 34, typically forming an overlap of approximately thirteen inches. An additional guardrail beam 34 installed at trailing edge 66 may be installed upon the rear face 41 of guardrail beam 34, forming an overlap of approximately thirteen inches.

Referring to FIG. 1A, a typical splice connection between adjacent guardrail beams 34 is illustrated. Upstream end 70 and downstream end 72 of adjacent guardrail beams 34 are configured to provide an overlapping splice connection. Guardrail beams 34 are typically fabricated from a flexible sheetmetal type material which allows adjacent beams 34 to be deformed and "lapped" together to form the interlock at each splice connection. The interlock at each splice connection helps keep guardrail beams 34 in alignment, with respect to each other, during a crash event. The interlock also operates to direct loads encountered by guardrail system 30 during a crash event in an axial direction along guardrail beam 34. This load path is optimum for bolted-joint or splice connection performance and for overall uniform response of guardrail system 30. This results in maximum energy dissipation from an impacting vehicle. Thus, optimum overall performance of guardrail system 30 is achieved.

Many of the edge conditions discussed and illustrated throughout this application as occurring at the top edge region 42 or bottom edge region 44 of guardrail beams 34 and 834, may be used interchangeably on the top edge region, bottom edge region or both. Furthermore, the edge conditions prevalent at the downstream ends, upstream ends, and/or intermediate portion of a given guardrail beam may also be utilized interchangeably. It will be recognized by those skilled in the art, that a single guardrail beam may employ one particular edge condition at the top edge region, and the same or a different edge condition at the bottom edge region, and that these edge conditions may occur at either end, the intermediate portion, or both.

Figures 4, 5, 6:
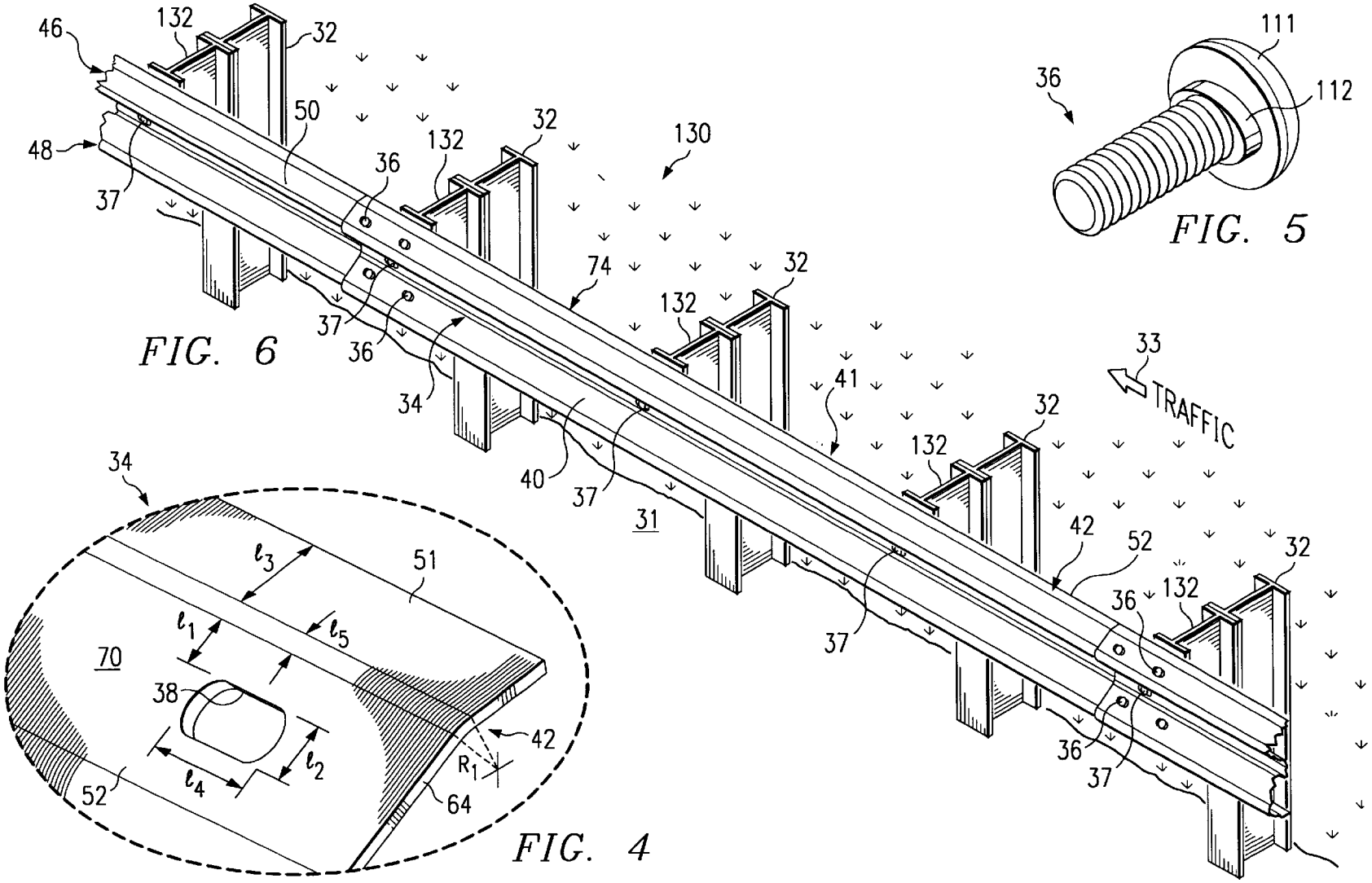
FIG. 4 is a schematic drawing with portions broken away, showing an enlarged isometric view, taken from FIG. 2, including a first edge region having a first, edge flange, a second, slot flange and a splice bolt slot formed in accordance with teachings of the present invention.
FIG. 5 is a schematic drawing showing an isometric view of a typical splice bolt which is sometimes specified for use with existing guardrail systems and may be satisfactorily used with guardrail beams or panels formed in accordance with teachings of the present invention.
FIG. 6 is a schematic drawing showing an isometric view with portions broken away of a guardrail system having guardrail panels or beams formed in accordance with teachings of the present invention installed along a roadway using metal blockouts and metal support posts.

Splice bolt slots 38 and post bolt slots 39 are typically elongate, and therefore larger than the respective diameter of bolts 36 and 37 which extend therethrough. Slots 38 and 39 allow bolts 36 and 37 additional movement axially and, therefore, absorb a significant portion of any applied force prior to fracture of bolts 36 and 37. Post bolt slots 39 and post bolts 37 are typically configured similar to, but longer than splice bolt slots 38, and splice bolts 36. This allows post bolts 37 to absorb additional energy during a crash condition. Splice bolt 36 shown in FIG. 5 represents one example suitable for use within teachings of the present invention. As discussed later in more detail, the present invention substantially increases the strength of splice bolt slots 38 formed in each second slot flange 52.

The following is a more detailed discussion of guardrail panel strength in the splice region. Emphasis is given in this discussion to the substantial improvements that are enabled through the application of the teachings of the present invention. The standard heavy gage W-Beam is referred to in this discussion as a benchmark design case in order to highlight specific advantages and synergistic performance improvements that are provided by the present invention.

In many existing guardrails, the guardrail tends to fail first near splice bolts positioned at the lowermost portion of any particular guardrail beam. Adjacent guardrail beams often become dislodged from their respective support posts in the following manner. A bending force applied through the guardrail beam or directly at a support post causes separation of the guardrail beams from the post. The interlock between adjacent guardrail beams 34 of the present invention minimizes nonuniform bending at each splice and allows adjacent guardrail beams 34 to slide axially relative to one another while minimizing local bending in the vertical plane or separation of the splice connection.

An additional local splice strengthening mechanism provided by the present invention may be highlighted as follows. When a splice joint such as shown in FIG. 1A is impacted directly by an external force, nonuniform deformation and thus local concentration of stresses that may cause failure of the splice joint is minimized. Also, forces from applied loads are distributed more uniformly between adjacent guardrail beams 34, splice bolts 36 and post bolts 37.

Figure 3A:
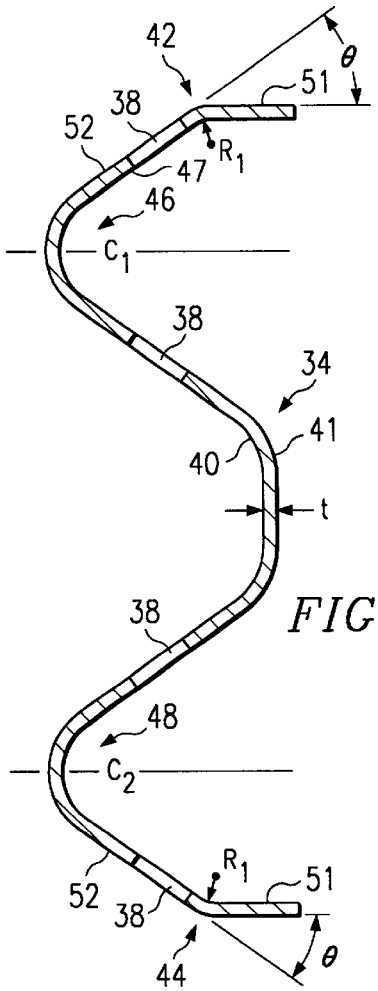
FIG. 3A is a schematic drawing in section, taken along line 3A—3A of the guardrail beam of FIG. 2.

Further details and examples of the implementation of the teachings of the present invention are provided as follows. As shown in FIGS. 2, 3A and 4, edge regions 42 and 44 preferably include a plurality of splice bolt slots or holes 38 formed within each second, slot flange 52 of guardrail beam 34. Radius $R_1$ is preferably formed between each first, edge flange 51 and the respective second, slot flange 52 having a value of between less than three-eighths of an inch and approximately one-sixteenth of an inch. For one application, radius $R_1$ has a value of approximately one-eighth of an inch. Standard W-beam guardrails have a corresponding radius of approximately three-eighths of an inch.

Each first, edge flange 51 preferably extends from the respective second, slot flange 52 at an angle theta (θ) as shown in FIG. 3A. The intersection of each first, edge flange 51 with its respective second, slot flange 52 is preferably selected to form an angle theta (θ) having a value of between twenty-five degrees and one hundred twenty-five degrees. For some applications angle theta (θ) preferably has a value of approximately thirty degrees.

Forming edge regions 42 and 44 with radius $R_1$ and angle theta (θ) in accordance with teachings of the present invention enables desired edge region behavior and facilitates incorporation of guardrail beam 34 into existing guardrail systems. Angle theta (θ) may be significantly modified within teachings of the present invention between a value of twenty-five (25°) to one hundred twenty-five degrees (125°).

Figure 3B:
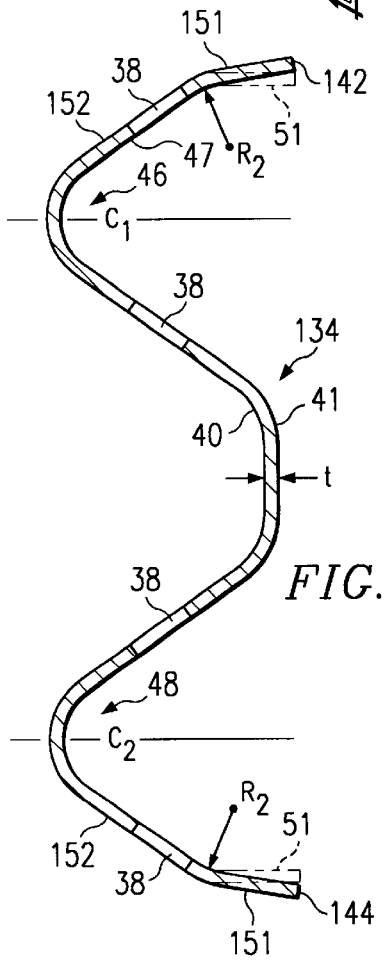
FIG. 3B is a schematic drawing in section similar to FIG. 3A and illustrates differences between a guardrail beam formed in accordance with teachings of the present invention (shown in dotted lines) and a typical standard heavy gauge W-beam profile as specified in AASHTO Standard Specification for Steel Beams for Highway Guardrail, Designation: M180-89.

FIG. 3B shows the cross section of standard heavy gauge metal W-beam 134 in solid lines. Dotted line portions 51 illustrate some important differences between standard W-beam 134 and guardrail beam 34 formed in accordance with teachings of the present invention. Conventional guardrail beams such as guardrail beam 134 typically terminate with blade edges 142 and 144 at the top and bottom of the cross section (see FIG. 3B). Blade edges 142 and 144 are susceptible to imperfections in the sheet of base material as well as damage during manufacture, shipping, handling, and installation. Imperfections along the edges of conventional guardrail beams may become stress concentration points or focal points at which failure of the guardrail can initiate during impact, and frequently results in tearing of the guardrail. This is why some guardrail designs incorporate edge-strengthening features on at least one edge flange, such as curled edges, hems or folds. Examples of these features are shown in copending patent application Ser. No. 09/405,434 filed Sep. 23, 1999 entitled "Guardrail Beam with Enhanced Stability" now issued as U.S. Pat. No. 6,290,047 and copending application Ser. No. 09/663,327 filed Sep. 18, 2000 entitled "Guardrail With Enhanced Stability."

Even a perfect, smooth "blade edge" of a conventional W-beam such as blade edges 142 and 144 of guardrail beam 134 as shown in FIG. 3B will experience a very localized point of high stress gradient due to the characteristic edge stress concentration associated with open sections of guardrail under bending loads. Thus, initiation of an edge "bulge" or "crimp" on a perfect, smooth blade edge is an imperfection that will grow or propagate easily and rapidly. This stress concentration may be made worse by the presence of any relatively small edge imperfections, even those on the order of size of the thickness of the sheet of base material used to fabricate conventional guardrail beams. The present invention increases the resistance of the guardrail to the initiation of crimping. It is also synergistic with such edge features as edge curls, folds and hems in increasing resistance to crimping.

For a conventional W-beam guardrail such as W-beam 134 as shown in FIG. 3B, each first, edge flange 151 extends from the respective second, slot flange 152 at less than the optimum angle as previously described for a guardrail beam incorporating teachings of the present invention. Radius $R_2$ formed between each first, edge flange 151 and the respective second, slot flange 152 has a value larger than the previously described radius $R_1$ for a guardrail beam incorporating teachings of the present invention. A conventional W-beam guardrail such as W-beam 134 does not include the optimum ratio between thickness and radius $R_2$ as previously described for a guardrail beam incorporating teachings of the present invention. Some design differences are summarized in the following table for this example.

| | Minimum Thickness (t) | Radius | Ratio R/t |
|---|---|---|---|
| Guardrail Beam 134 (conventional W-beam) | 0.096 inches | $R_2$ = ⅜ inch | 3.9 |
| Guardrail Beam 34 (one example of present invention) | 0.096 inches | $R_1$ = 3/16 inch | 2.0 |

Edge regions 42 and 44 stabilize guardrail beam 34 and make it more resistant to twisting while also spreading stresses more uniformly between first flange 51 of edge region 42 and first flange 51 of edge region 44 thereby substantially decreasing the tendency of guardrail beam 34 to tear upon vehicle impact. Such tearing often starts at the splice bolt slots of standard W-beam guardrails. Edge regions 42 and 44 maximize residual strength of guardrail beam 34 which makes guardrail beam 34 resistant to tearing at intermediate portion 74 while preventing cracks formed at splice bolt slots 38 from extending through the associated edge region. As discussed later in more detail, margin $l_5$ formed in accordance with teachings of the present invention provides a crack barrier or crack roadblock. Again, this crack barrier effect is synergistic with such edge features as curls, folds, or hems.

FIG. 4 is an enlarged drawing showing a portion of first edge region 42 of guardrail beam 34 adjacent to leading edge 64. For one embodiment of the present invention, edge regions 42 and 44 and splice bolt slots 38 may have the following typical dimensions.

| |
|---|
| $l_1 \approx$ 3/16 inch |
| $l_2 \approx$ 29/32 inch |
| $l_3 \approx$ 1–1/16 inch |
| $l_4 \approx$ 1–1/8 inch |
| $l_5 \approx$ 3/8 inch |

The dimension $l_1$ represents the distance from splice bolt slot 38 to the region defined by the radius $R_1$. The dimension $l_5$ represents the arc distance or margin traced by the radius $R_1$. The dimension $l_3$ represents the distance between the arc traced by radius $R_1$ and the extreme edge of first, edge flange 51. Dimensions $l_2$ and $l_4$ represent the dimensions of the splice bolt slot.

Since guardrail beam 34 is generally symmetric about the longitudinal axis, the same dimensions shown in FIG. 4 may also be used to describe the bottom corner splice bolt slot and dimensions of second region edge 44. The thickness (t) of guardrail beam 34 is typically about 0.096 inches. For some applications, the value of $R_1$ is preferably equal to or less than the value of $l_3$ divided by five (5) in order to maximize the benefit that edge flange 51 is able to give to the adjacent slot flange in forming a barrier to crack propagation. For other applications, the value of $R_1$ may be equal to or less than the value of $l_3$ divided a number between the approximate range of four (4) to eight (8).

The portion of second edge region 44 or bottom edge region 44 which corresponds with the portion of first edge region 42 as shown in FIG. 4 is particularly important because of the way that standard W-beams such as W-beam 134 typically respond which is by flattening in the generally vertical plane during a crash event. This flattening can occur along one crown 48 or over the entire cross section (including crowns 48 and 46), depending on the height of the bumper of an impacting vehicle (not expressly shown) with respect to the guardrail height, vehicle speed, angle of impact, vehicle type, and the nature of any contact of the tires of the vehicle with the guardrail, among other variables. In addition, the crash event itself may produce some vertical motion of a guardrail system that affects the nature of the contact and the resulting flattening behavior.

It is common however, during crash events, for one crown to flatten more than the other. Often it is the lower crown or crown closer to the ground such as crown 48 that flattens the most because of the combination of bumper and tire contact during the crash event. This is an important response because it often produces a failure mode near the "W-beam" splice that has been recognized by those versed in the art associated with crash testing as characteristic of a typical "W-beam" guardrail system. One concern about this failure mode is that it may be caused quite unexpectedly by rather small vehicles.

The following description explains the mechanism of this failure mode and how teachings of the present invention directly address this nagging industry problem in a novel and practical way. During a crash event, the bumper and tire of a vehicle may contact guardrail system 30 producing a combination of forces that tend to flatten crowns 46 and 48 causing guardrail system 30 to have high tensile forces along its longitudinal axis, and also producing torsion in guardrail system 30 as the rotating tires contact guardrail beams 34 and push guardrail system 30 downward in the region of contact. In addition, when a small vehicle with a relatively low bumper contacts guardrail system 30 during a crash, even if the tire contact with guardrail system 30 is limited, the low bumper contact itself pushes on the bottom half of guardrail beams 34 causing deformation of guardrail system 30 in the general plane of the guardrail beams 34. A typical result may be flattening mainly in the bottom half of guardrail beams 34 under various loads including tension along its longitudinal axis and torsional loads that try to bend guardrail beams 34 in the general plane of guardrail system 30.

When the bottom half of a standard W-beam such as guardrail beam 134 is flattened, the following geometry changes can result locally. First, the distance (moment arm) from the bottom splice bolt slots 38 to the center of torsion of the associated splice is increased, causing torsional loads to be relatively higher at these locations as compared with other splice bolt slots 38 at locations having shorter moment arms.

In addition, flattening of the bottom crown 48 of a downstream guardrail beam 134 as the vehicle approaches, tends to result in a local shearing or sliding mechanism between the upstream and downstream guardrail panels 134 at the bottom splice bolt slots 38. Furthermore, this sliding effect tends to be increased toward the downstream end of the splice because the material near the end of the upstream panel is relatively unsupported by adjacent material, making it more easily deformed, and flattened. Finally, because the upstream panel 134 is generally further away from the center of curvature of the cross section of the overlapping bottom crowns 48 of the combined panels 138, a flattening of the combined bottom crowns 48 can result in a significant sliding of the upstream panel 134 relative to the downstream panel 134 near the bottom of each panel, including the local region of the bottom splice bolt slots 38. This results in a significant shearing action that causes the upstream bottom splice bolt slot 38 to exert a significant force along its top edge on the respective slot bolt. This force drives this bolt laterally against the bottom edge of the bottom splice bolt slot 38 of the downstream panel 134. This driving effect can be greatest near the bottom corner slot of upstream panel 134 because of the lack of restraint described above. At this same location the bottom splice bolt slot 38 of the downstream panel 134 is not near a panel end. It is thus more highly constrained and as a result is relatively unable to deform rather than fracture in response to the bolt being punched or driven against its lower edge.

A vector analysis of the various tension, torsion, and sliding or shearing forces may be performed on each splice bolt of a splice. The effects of these forces and resulting stress intensities along the edges of each splice bolt slot 38 may then be evaluated. When other than round bolt shoulders are present, this evaluation may include the geometric influence that is exerted by the preferred orientation of the bolt shoulders in the splice bolt slots that is due to nut tightening during installation. In this way, the effect of the bolt shoulder shape and orientation in each slot can be evaluated and included in terms of their contribution to local stress intensities in the panel near the slot. A fracture mechanics approach is one method of evaluating the panel response due to the various combinations of forces and geometries at each slot, and may even include the effects of material inclusions or edge notches at the slot or at the panel edge.

When a force vector analysis is performed on a standard W-beam such as W-beam 134, it becomes evident that the worst-case resultant or combination of these forces and their directions is commonly found at the splice bolt slot of the downstream panel that is under the bottom corner splice bolt slot of the associated upstream panel. The individual forces generally tend to push the splice bolt in a downward direction that results in very high local stresses that try to cause the bottom splice bolt slot of the downstream panel to fail near the panel edge at this location. Since most of the individual bolt force components generally combine to complement each other at this location, the end result is generally the same, within a fairly wide range of individual force component contributions. This is how it is possible for a wide range of crash test variables to come together to rather consistently produce the same predominant failure mode at this particular location of a standard W-beam such as W-beam 134.

The present invention addresses this serious problem in the following simple and novel manner. Major performance improvements may be effectively accomplished by forming guardrail beam 34 in accordance with teachings of the present invention to resist the effects of these combined forces. The improvements resulting from forming edge regions 42 and 44 according to the teachings of the present invention significantly contribute to the success of guardrail system 30 in resisting vehicle impacts.

It should be noted that the improvements represented by guardrail system 30 and guardrail beams 34 and the almost shocking simplicity of implementation did not come about by accident, but through years of directed painstaking research that addressed every possible avenue of improvement for this important member of the roadway safety engineer's toolbox. Thus, the sophistication and elegance of the present invention are contained in the simplicity of and significance of the results that it brings to bear upon a current problem of national importance.

The present invention generally works in the following manner to strengthen guardrail beam 34 at its most failure prone locations, which include splice bolt slots 38 near the corners of second edge region 44. The edge geometry represented in FIG. 4 is used for this discussion. In this discussion the length $l_5$ of the arc traced by radius $R_1$ is referred to as the "margin".

For a loaded splice bolt in a slot 38 near the edge of guardrail beam 34, the bolt loads against the slot edge result in various stress intensities around the perimeter of splice bolt slot 38 and into the adjacent panel material. For a standard W-beam guardrail panel such as W-beam 134, these stress intensities and the inherent material or manufacturing flaws that they can cause to propagate as cracks at or near a slot edge are not greatly influenced by nearby edge flange or margin geometries. In other words, the local stress intensities are not greatly affected by them.

The standard W-beam geometries in question include a relatively large radius (typically three-eighths of an inch) relative to thickness t. As a result, the stress intensities in this region of guardrail beam 134 and the flaws that may be able to grow as cracks which can result in panel failure as described above, are not significantly influenced by the presence of the edge flange as a strengthening feature. In fact, in the case of a standard W-beam guardrail, cracks may almost grow as if the radius was extremely large and the edge flange and adjacent slot flange were actually in the same plane as the slot itself. The result from a fracture mechanics standpoint is that a crack that grows from an edge splice slot region of guardrail beam 134 toward the nearest guardrail edge 142 or 144 can do so in a relatively quick and unimpeded manner. This is because as the crack grows, the crack tip stress intensity also rises in an ever-increasing manner. In this way, unstable, rapid crack growth may occur as the crack grows from the slot toward the panel edge.

Under these conditions, this ever-larger crack can rapidly extend toward the blade edge 142 or 144 across the associated slot flange and edge flange. At each step of its growth, its propensity for yet further crack growth increases with crack size, relatively unchecked, and without bound, all the way to the blade edge 142 or 144. Once blade edge 142 or 144 is reached by the crack, the final failure of the guardrail splice generally occurs as a rapid sheet-tearing failure of the downstream W-beam panel across the remaining section, roughly following the direction of the line defined by the end of the upstream W-beam panel from the bottom to the top of the associated W-beam panel. This splice bolt slot cracking and the resulting system failure of a standard W-beam can be sudden and sometimes catastrophic in its consequences for affected motorists.

In direct and sharp contrast to the above characteristics of a standard W-beam, the following novel and synergistic changes may be made to guardrail beam 34 in accordance with teachings of the present invention. First, the radius $R_1$ is made to be equal to or less than about 3.5 times the thickness "t" of the material. Next, the resulting angle theta ($\theta$) between the second, slot flange 52 and the first, edge flange 51 is adjusted to be between about twenty-five degrees (25°) and one hundred twenty-five degrees (125°). Now quite a different result is obtained. This is because several synergistic effects are simultaneously activated.

First, the strain hardening of the material in the margin $l_5$ is greatly increased, thus offering a barrier of higher strength material through which a crack must pass on its way from the edge region splice bolt slot 34 to the nearby first, edge flange 51. This "crack-opening restraint" or barrier must be overcome by an approaching crack if the crack is to continue in its path toward the adjacent first, edge flange 51. Second, and perhaps equally important as the presence of this strain hardened, higher-strength material region at $l_5$ is the rather sharp angular transition that results between first, edge flange 51 and the adjacent second, slot flange 52. This is because this transition can define yet another formidable crack barrier, for the correct choice of transition angle theta ($\theta$). Thus, for a sufficiently small radius $R_1$, both barriers work together synergistically to give additional definition and great emphasis to the presence of the respective edge regions 42 and 44 as formidable crack barriers.

Edge regions 42 and 44 provide distinct regions of material that are effectively not oriented in the plane of an approaching crack moving toward the first, edge flange 51 and are also sufficiently large in area and moment of inertia (considering dimension $l_3$ and thickness) as to offer significant edge restraint to the adjacent second, slot flange 52. This edge restraint synergistically increases the effectiveness of the strain hardened margin $l_5$ by giving it further local geometric stability and support against distortion in the presence of an approaching crack. This effect is generally optimum for angles theta ($\theta$) between 25 and 125 degrees. This same crack barrier may effectively limit the growth of cracks originating from defects in the extreme edge or blade edge of first, edge flange 51. It may also be noted that this effect works synergistically with edge features such as curls, hems and folds.

Thus, the combination of factors associated with edge regions 42 and 44 uniquely and synergistically work together in a novel manner to effectively manage the general orientation of local stresses near a crack tip, and at the same time to offer an effective barrier to the growth of a crack. With these factors working together, the "crack roadblock" is completed. Under these optimum conditions, the previously ever-increasing stress intensity at a crack tip as the crack grows larger and extends toward a blade edge is transformed into a formidable crack barrier at margin $l_5$ of guardrail beam 34. The effect of this barrier at margin $l_5$ includes substantially reducing any propensity for the crack growth to increase without bound. In fact, the diametric opposite of previous behavior is now true. The crack tip stress intensity and thus the propensity for further crack growth associated with splice bolt slots 38 in edge regions 42 and 44 may now decline dramatically as a crack approaches margin $l_5$. In this way, the above failure mode that has plagued the standard W-beam guardrail system may be effectively addressed, thus restoring greater reliability and consistency to this nationally important safety barrier without making it even heavier.

Some further features of the new guardrail system may be illustrated as follows. FIG. 5 is a schematic drawing showing a typical splice bolt 36 which may be satisfactorily used to couple guardrail beam or panel 34 with similar guardrail beams or panels. Also, splice bolt 36 may be satisfactorily used to couple guardrail beam or panel 34 with a standard heavy gauge metal W-beam guardrail. A typical splice bolt 36 includes button head 111 and oval shaped shoulder 112. As shown in FIGS. 1, 1A and 6, splice bolt 36 may be satisfactorily used to attach overlapping guardrail panels 34 formed in accordance with each other in an overlapping arrangement corresponding with standard heavy gauge metal W-beam guardrail systems.

Figure 7:
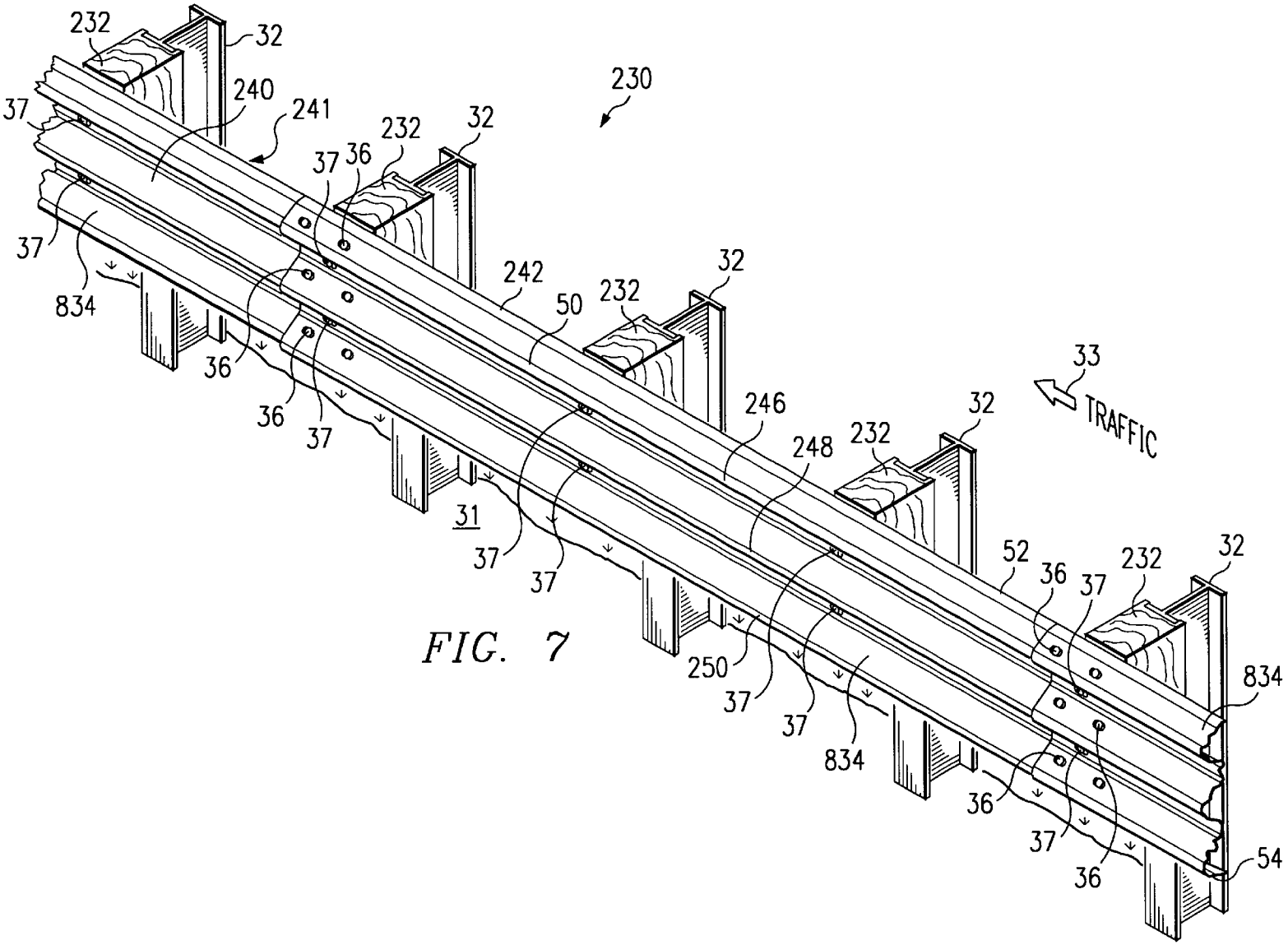
FIG. 7 is a schematic drawing showing an isometric view with portions broken away of another guardrail system having guardrail panels or beams formed in accordance with teachings of the present invention installed along a roadway using wooden blockouts and metal support posts.
Figure 8:
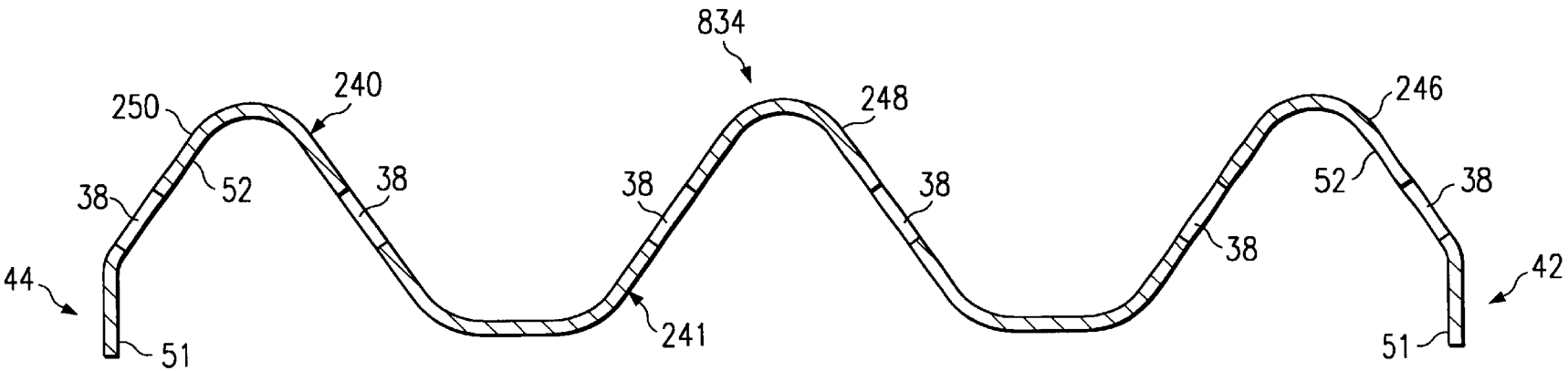
FIG. 8 is a schematic drawing in section of a guardrail beam or panel satisfactory for use with the guardrail systems shown in FIG. 7.

FIGS. 6, 7, and 8 illustrate various guardrail systems and beam design configurations suitable for use within teachings of the present invention. Referring to FIG. 6, guardrail system 130 is shown installed adjacent to roadway 31. Guardrail system 130 includes many of the same features and components as previously described guardrail system 30. For the embodiment of the present invention as shown in FIG. 6, guardrail system 130 includes a plurality of metal blackouts 132 which are disposed between respective support posts 32 and backface 41 of guardrail beams 34.

Guardrail system 230 incorporating a further embodiment of the present invention is shown in FIG. 7 installed adjacent to roadway 31. Guardrail system 230 includes a plurality of support posts 32 anchored adjacent to roadway 31 with guardrail beams 834 attached to posts 32 by a plurality of wooden blackouts 232 post bolts 37. Guardrail system 230 includes many of the components and features of previously described guardrail system 30. For the embodiment of the present invention as shown in FIG. 7, guardrail beam 34 has been replaced by guardrail beam 834. Guardrail beam 834 as shown in FIGS. 7 and 8 may sometimes be referred to as a thrie-beam. Guardrail beam 834 includes front face 240 and a rear face 241. Guardrail beams 834 are preferably mounted on support post 32 with front face 240 disposed adjacent to roadway 31.

Guardrail beam 834 also includes first edge region 242 and second edge region 244. For the embodiment of the present invention as shown in FIG. 8, the configuration of first edge region 242 corresponds generally with previously described first edge region 42 and second edge region 244 corresponds generally with previously described second edge region 44. Guardrail beam 834 also includes first crown 246, second crown 248 and third crown 250 disposed between first edge region 242 and second edge region 244. First edge region 242, first crown 246, second crown 248, third crown 250 and second edge 244 extend generally parallel with each other along the length of guardrail beam 834. First edge region 242 and second edge region 244 preferably include respective first, edge flange 51 and second, slot flange 52 as described in detail with respect to guardrail beam 34.

Although the present invention has been described by several embodiments, various changes and modifications may be suggested to one skilled in the art. It is intended that the present invention encompasses such changes and modifications as fall within the scope of the present appended claims.

What is claimed is:

1. A guardrail beam for installation as part of a guardrail system extending along a roadway, comprising:

a first edge region and a second edge region with the second edge region spaced from and extending generally parallel with the first edge region;

a plurality of crowns disposed longitudinally along the guardrail beam between the first edge region and the second edge region;

each edge region defined in part by a respective first, edge flange and an adjacent second, slot flange;

each second, slot flange including a plurality of slots spaced longitudinally from each other and sized to allow splicing the guardrail beam with a standard metal W-beam;

a respective radius formed between each first, edge flange and the adjacent second, slot flange;

each radius having a value between less than three-eighths of an inch and one-sixteenth of an inch;

each first, edge flange extending from the adjacent second, slot flange at an angle having a value between approximately twenty-five degrees and one hundred twenty-five degrees; and each first edge flange and the adjacent second, slot flange cooperating with each other to provide improved stabilization against crack growth originating near the respective slots and at other locations along the guardrail beam resulting from the combined effect of the respective radius and the associated angle.

2. The guardrail beam of claim 1, further comprising a plurality of post bolt slots disposed within the guardrail beam for attaching the guardrail beam to a plurality of support posts associated with a conventional guardrail system.

3. The guardrail beam of claim 1 further comprising the angle between each first, edge flange and the adjacent second, slot flange having a value of approximately thirty degrees.

4. The guardrail beam of claim 1, further comprising at least two crowns disposed between the first edge region and the second edge region.

5. The guardrail beam of claim 1, further comprising three crowns disposed between the first edge region and the second edge region.

6. The guardrail beam of claim 1, further comprising the radius having a value of approximately three-sixteenths of an inch.

7. The guardrail beam of claim 1, further comprising:

the angle at each first, edge flange extending from the second, slot flange having a value between approximately thirty degrees and one hundred and twenty degrees; and the value of each angle varying along the length of each edge region.

8. The guardrail beam of claim 1, further comprising a thickness having a value of t and each radius having a value equal to or less than approximately three times t.

9. A guardrail beam for installation as part of a guardrail system extending along a roadway, comprising:

a first edge region and a second edge region with the second edge region spaced from and extending generally parallel with the first edge region;

a plurality of crowns disposed longitudinally along the guardrail beam between the first edge region and the second edge region;

each edge region defined in part by a respective first, edge flange and an adjacent second, slot flange;

each second, slot flange including a plurality of splice bolt slots spaced longitudinally from each other and sized to allow splicing the guardrail beam with a standard heavy gauge metal W-beam;

a respective angle formed by each first, edge flange and the adjacent second, slot flange;

each angle having a value between approximately twenty-five degrees and one hundred twenty-five degrees;

strain hardened material disposed between each first, edge flange and the adjacent second, slot flange; and the strain hardened material cooperating with the respective angle formed between each first, edge flange and the adjacent second, slot flange to form a barrier to growth of cracks from the splice bolt slots in the second, slot flange to the first, edge flange.

10. The guardrail beam of claim 11, further comprising three crowns disposed between the first edge region and the second edge region.

11. The guardrail beam of claim 9, further comprising each radius having a value of approximately three-sixteenth of an inch.

12. The guardrail beam of claim 9, further comprising each angle having a value of approximately thirty degrees.

13. The guardrail beam of claim 9, further comprising at least two crowns disposed between the first edge region and the second edge region.

14. The guardrail beam of claim 9, further comprising three crowns disposed between the first edge region and the second edge region.

15. The guardrail beam of claim 9, further comprising:

a respective radius formed between each, first edge flange and the adjacent second, slot flange; and each radius having a value between less than three-eighths of an inch and approximately one-sixteenth of an inch.

16. The guardrail beam of claim 15, further comprising each radius having a value of approximately one-eighth of an inch.

17. The guardrail beam of claim 9, further comprising each angle having a value of approximately thirty degrees.

18. A guardrail beam for installation as part of a guardrail system, comprising:

first edge region and a second edge region with the second edge region spaced from and extending generally parallel with the first edge region;

at least two crowns extending longitudinally along the guardrail beam disposed between the first edge region and the second edge region;

each edge region defined in part by a respective first, edge flange and an adjacent second, slot flange;

each second, slot flange including a plurality of splice bolt slots disposed within the guardrail beam wherein the splice bolt slots allow splicing the guardrail beam with a standard heavy gauge metal W-beam;

a plurality of post bolt slots disposed within the guardrail beam for attaching the guardrail beam to respective support posts associated with a conventional guardrail system;

a respective radius formed between each first, edge flange and the adjacent second, edge flange;

each radius having a value of approximately three sixteenths of an inch;

each first, edge flange extending from the adjacent second, slot flange at an angle having a value of approximately thirty degrees;

the beam having a thickness with a value of t and each radius having a value equal to or less than three times t;

the first edge region and the second edge region having a respective radius formed between each first, edge flange and the adjacent second slot flange;

the respective angle and the respective radius of each edge region cooperating with each other to improve fracture resistance by providing better stabilization against crack growth near each splice bolt slot and other portions of the guardrail beam;

each first, edge flange extending from the adjacent second, slot flange at an angle having a value between approximately twenty-five degrees and one hundred twenty-five degrees; and the first, edge flange and the adjacent second, slot flange of each edge region cooperating with each other to provide improved stabilization against crack growth originating near the slots and at other locations along the guardrail beam resulting from the combined effect of each radius and the associated angle.

19. A method for forming a guardrail beam for installation as a part of a guardrail system extending along a roadway, comprising:

forming a first edge region and a second edge region in a sheet of base material with the second edge region spaced from and extending generally parallel with the first edge region;

forming at least two crowns in the sheet of base material disposed between the first edge region and the second edge region with the crowns extending generally parallel with the first edge region and the second edge region;

forming each edge region with a respective first, edge flange and an adjacent second, slot flange with the second, slot flange extending generally parallel with the respective first, edge flange;

forming a plurality of slots in each second, slot flange with the slots spaced longitudinally from each other and sized to allow splicing the guardrail beam with a standard metal W-beam;

forming a respective radius between each first, edge flange and the adjacent second, slot flange with each radius having a value which is equal to or less than approximately three and one-half times the thickness (t) of the sheet of base material;

forming an angle between each first, edge flange and the adjacent second, slot flange, with the angle having a value between approximately twenty-five degrees and one hundred twenty-five degrees;

selecting the value of each radius and the value of the associated angle to enhance fracture resistance of the guardrail beam and provide better stabilization against crack growth near each slot; and forming work hardened material between each first, edge flange and the adjacent second, slot flange during formation of the associated radius.

20. The method of claim 19 further comprising forming an angle, between each first, edge flange and the adjacent second, slot flange, with a value of approximately thirty degrees.

21. The method of claim 19 further comprising forming the respective radius between each first, edge flange and the adjacent second, slot flange with the value between less than three-eights of an inch and approximately one-sixteenth of an inch.

22. The method of claim 19 further comprising the radius formed between each first edge flange and the adjacent second slot flange having a value of approximately one-eighth of an inch.

23. The method of claim 19 further comprising roll forming the guardrail beam.

24. The method of claim 19 further comprising the sheet of base material formed from steel alloys used to form standard heavy gauge metal W-beams.

* * * * *